US008955618B2

(12) United States Patent
Paul et al.

(10) Patent No.: US 8,955,618 B2
(45) Date of Patent: Feb. 17, 2015

(54) TOOL FOR CRUSHING COKE

(75) Inventors: Wolfgang Paul, Hamburg (DE); Kay Simon, Iserlohn (DE)

(73) Assignee: Ruhrpumpen GmbH (DE)

( * ) Notice: Subject to any disclaimer, the term of this patent is extended or adjusted under 35 U.S.C. 154(b) by 642 days.

(21) Appl. No.: 13/242,137

(22) Filed: Sep. 23, 2011

(65) Prior Publication Data

US 2012/0138324 A1 Jun. 7, 2012

(30) Foreign Application Priority Data

Sep. 23, 2010 (DE) ..... 10 2010 037 725

(51) Int. Cl.

| | |
|---|---|
| ***B25B 21/00*** | (2006.01) |
| ***E21B 3/00*** | (2006.01) |
| ***E21B 17/22*** | (2006.01) |
| ***E21B 19/16*** | (2006.01) |
| ***E21B 19/18*** | (2006.01) |
| ***C10B 33/00*** | (2006.01) |

(52) U.S. Cl.
CPC ..... *C10B 33/006* (2013.01)
USPC ..... 173/218; 173/47

(58) Field of Classification Search
USPC ..... 173/13–17, 47, 24–28, 184–185, 218
See application file for complete search history.

(56) References Cited

U.S. PATENT DOCUMENTS

| | | | | |
|---|---|---|---|---|
| 4,275,842 | A * | 6/1981 | Purton et al. | 239/446 |
| 4,738,399 | A * | 4/1988 | Adams | 239/447 |
| 4,923,021 | A * | 5/1990 | Courmier et al. | 175/382 |
| 5,816,505 | A * | 10/1998 | Tran et al. | 239/443 |
| 6,644,567 | B1 * | 11/2003 | Adams et al. | 239/566 |
| 7,695,071 | B2 * | 4/2010 | Jackson et al. | 299/1.05 |
| 7,819,343 | B2 * | 10/2010 | Paul et al. | 239/446 |
| 8,002,204 | B2 * | 8/2011 | Paul et al. | 239/443 |
| 8,197,644 | B2 * | 6/2012 | Lah | 201/2 |
| 8,679,298 | B2 * | 3/2014 | Lah | 202/241 |
| 2003/0127314 | A1 * | 7/2003 | Bell et al. | 202/262 |
| 2009/0165617 | A1 * | 7/2009 | Paul et al. | 83/177 |
| 2009/0301744 | A1 * | 12/2009 | Swinford | 173/200 |

FOREIGN PATENT DOCUMENTS

| | | |
|---|---|---|
| CA | 2685948 | 7/2009 |
| DE | 102007063329 | 6/2009 |
| WO | 2005105953 | 11/2005 |

* cited by examiner

*Primary Examiner* — Robert Long
(74) *Attorney, Agent, or Firm* — Luedeka Neely Group, P.C.

(57) ABSTRACT

A tool for crushing coke using high-pressure water is attached to a drilling rod through which water flows at high pressure. The tool further a control device for directing the water into either drilling nozzles or cutting nozzles depending on the rotational position of the control device. A switching element driven by water pressure engages the control device to cause the control the device to rotate from one rotational position to another rotational position, thereby changing the tool from cutting to drilling or vice versa.

17 Claims, 6 Drawing Sheets

TOOL FOR CRUSHING COKE

Figure 1:
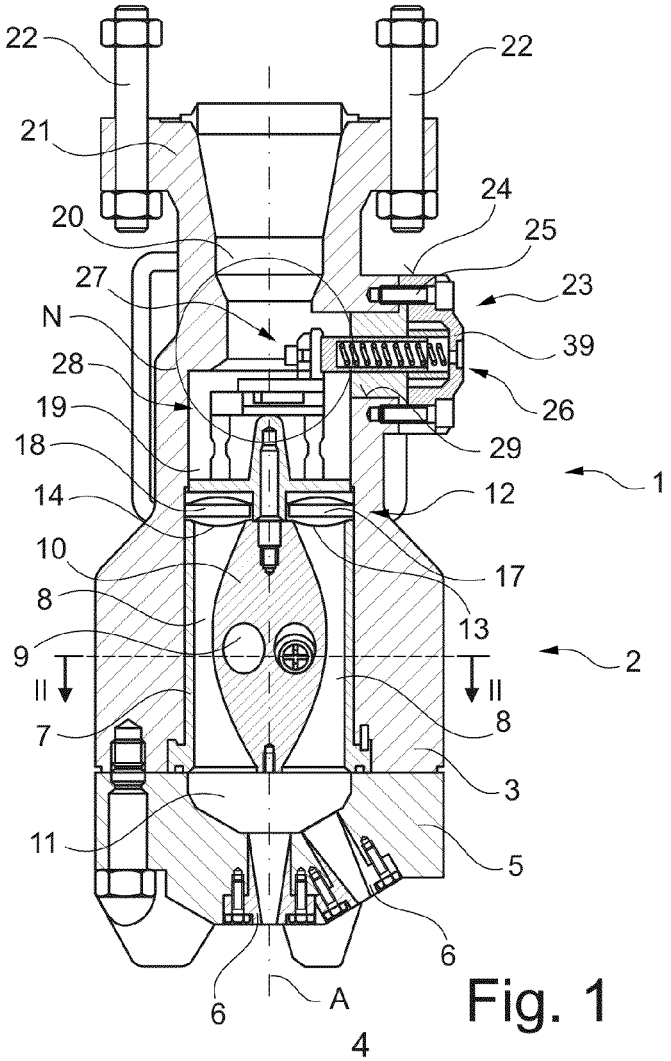

This application claims priority to German Patent Application No. 10 2010 037 725.2 filed Sep. 23, 2010.

DESCRIPTION

The invention relates to a tool for crushing coke with a housing that, in the operating state of the tool, is attached at the end of a rotatably drivable drilling rod, at least one cutting nozzle for cutting and at least one drilling nozzle for drilling coke in a drum by means of a water jet, an inflow channel in the housing to feed in water flowing into the housing through the drilling rod under pressure in the operating state of the tool, a valve unit for distributing water being fed in through the inflow channel over flow channels to the cutting nozzle and to the drilling nozzle, a control device that can be rotated around the longitudinal axis of the housing to actuate the valve unit, wherein the flow path of the water to the cutting nozzle or the flow path to the drilling nozzle is released or blocked depending on the angular position of the control device, a switching device for switching the tool over from the cutting function to the drilling function and vice versa by means of the control device and a driving device to actuate the switching device, wherein the driving device can be automatically actuated by a pressure accumulator in dependence upon changes in the pressure of the water, the operating pressure of the water is reduced to a switching pressure and the switching pressure is increased again to the operating pressure after the switching with said changes, and the switching device is located in the water flow from the inflow channel and to rotate the control device around a switching angle, includes a switching element that at the switching pressure of the water, can be moved by the driving device from an inactive position transversally to the longitudinal axis of the housing into an active position in a linear fashion and that can be moved back into the inactive position in the switching device when there is an increase of the pressure of the water over the switching pressure and that is coupled to means for converting the linear movement into a rotary movement of the control device, wherein the switching element can be brought into engagement with control parts of the control device to rotate the control device.

An automatically switchable tool of this type is known from DE 10 2007 063 329 B3, which is based on the manually switchable tool in accordance with WO 2005/105953 A1. This manually switchable tool has, in a housing supplied with drilling and cutting nozzles, an essentially cylindrical flow element that four flow channels extend through; their upper openings can be closed in pairs via two disk-shaped closing elements of a valve unit.

The valve unit is located in a flow-through channel to which water flows under high pressure when the tool is operated from a drilling rod to which the tool is attached with a flange that surrounds an inflow channel. When the tool is operated, water flows under high operating pressure into the tool and, depending on the switch position of a control device that connects a switching device to the valve unit, is either carried off there through the flow channels and an extension connected to them or is fed into the cutting nozzles through corresponding flow channels and carried off there to drill or cut the coke material.

The control device for the valve unit has a guide device for the closing elements to switch the tool over from "drilling" to "cutting" and vice versa. The two diametrically opposed closing elements can be moved with it, as a choice, to a pair of openings in the flow element for the drilling function or to a different pair of openings for the cutting function there. When the opening pair for the drilling function is closed by the closing elements, the opening pair for the flow paths of the water for cutting is free and vice versa.

To switch over from the drilling function to the cutting function, the operating pressure is reduced and the control device is rotated by 90° in each case by a gearbox that can be manually actuated from the outside as a driving device. The gearbox consists in this case of a bevel gear that is meshed with a corresponding bevel gear in the top part of the control device and that brings about a rotation of the control device of the guide device by 90° to switch over the tool.

This known tool is developed further in accordance with DE 10 2007 063 329 B3 in that the driving device can be automatically actuated via a pressure accumulator in dependence upon changes in the pressure of the water, the operating pressure of the water is reduced to a switching pressure and the switching pressure is increased again to the operating pressure with said changes, and the switching device is located in the water flow from the inflow channel and, to rotate the control device around a switching angle, includes a switching element that can be moved by the driving device from an inactive position transversally to the longitudinal axis of the housing into an active position in a linear fashion at the switching pressure of the water and that can be moved back into the inactive position in the switching device when there is an increase of the pressure of the water over the switching pressure and that is coupled to means for converting the linear movement into a rotary movement of the control device.

The rotation of the control device that is intended to switch the tool over from the drilling function to the cutting function and vice versa is consequently automatically carried out around an angle required for the switch-over in dependence upon the pressure of the water in the tool with a switching device that is located above the area of the flow separation or more precisely of the valve unit, namely in the water flow from the inflow channel. The components of the switch-over device therefore freely exist in the flow of the water because of that, and they are continuously cleaned and lubricated. Not much space is required. The switching element is coupled to means for converting its linear movement into a rotary movement of the control device.

A strong lowering of the operating pressure of the water for the switch-over from approx. 300 bar to 15 bar, for instance, is preferred; it will be referred to as the switching pressure below.

The movement of the switching element that is directed transversally to the longitudinal axis of the housing permits a space-saving arrangement of the switching device, so that an extension of the housing is not required. The prior tool height can instead be retained, just like the previous setup and the valve device of the tool that is provided with closing elements, which has a very advantageous effect.

The switching element is in engagement with a control part to rotate the control device, in order to convert the linear movement of the switching element into a rotary movement of the control element. The control part is designed as a control profile here with which the switching element can be brought into engagement by the driving device of the switching device to rotate the control device.

The movement of the switching element takes place between an active position and an inactive position in the switching device. Since the rotary movement of the valve unit for the rerouting of the further path of the water is brought about with the control device, the transition of the switching element from the inactive position to the active position takes place at a switching pressure of the water that is as low as possible, in order to keep the strain and especially the friction of the components directly participating in the switch-over as low as possible.

At its free end section, the switching element has a switching link that is in engagement with the control profile of the control device when the control device is rotated.

The driving device includes a cylinder and a piston that can be moved in a linear fashion with the cylinder and that is connected to the switching element; the piston is under the effect of a spring that presses the piston from the inactive position into the active position when the switching pressure arises in the water. The linear movement of the switching element takes place via the movement of the piston in the cylinder. In the inactive position, the piston is pulled back and the spring is pressed together. When the pressure in the water is reduced to the switching pressure to switch the tool over, the tension in the spring is released and the spring drives the piston from the inactive position into the active position so that the switching link of the piston is brought into engagement with the control profile of the control device and brings about the switch-over.

The spring and the piston keep the switching link in engagement with the control profile during the switch-over of the control device, and they are pressed back into the inactive position when a pressure lying over the switching pressure of the water is brought about. The spring, as part of the driving device, is coordinated to the force acting on the piston at the switching pressure in such a way that the switching link remains engaged with the control profile during the duration of the switch-over movement of the control device, and the piston returns to the inactive position at the end of the switch-over movement when the switching pressure is exceeded again.

It is provided that the switching angle of the control device will essentially be 90° and that the control profile will have two control curves for this that are separated by a wall and that are arranged in a mirror-image fashion, one of which is assigned to the switch-over of the water flow from cutting to drilling and the other of which is assigned to the switch-over of the water flow from drilling to cutting.

It turned out that the control profile with the control curves arranged in a mirror-image fashion is exposed to high bending and friction forces in connection with the required spring-swiveling bearings of the switching link, which has to be kept in engagement with the control profile for the duration of the switch-over; a relatively high amount of resources are required to get control of this during the production and maintenance of the tool.

The problem therefore exists of creating a robust switching device and control device for the tool mentioned at the outset while basically retaining the driving device for the actuation of the switching device.

This problem is solved by the control device having four control parts concentrically offset by 90° to each other at the height of the switching element, the switching element being provided with a head and the control device of the switching device being allocated and designed in such a way that the head is brought into engagement during the forward movement of the switching element from the inactive position to the active position with the control part among the four control parts that is in a readiness position in front of the head at the end of a prior switch-over when the switching element has taken its inactive position and that the head carries along this control part via the linear movement of the switching element so that the control device is rotated by 90°.

The switch-over of the tool is automatically brought about in accordance with the invention by the switching element being extended out by the driving device when the water pressure is reduced to the switching pressure and its head at the front end engaging in the process with a control part located in a readiness position in front of the head so that the control part is carried along by the head with the linear movement of the switching element and the control device is rotated in that way by 90° . As described at the outset, the rotation of the control device by 90° brings about a corresponding rotation of the valve unit with the consequence that the flow path of the water is changed and is now namely no longer released or blocked to the cutting nozzles, but instead to the drilling nozzles. It is important in the process that the movement of the head of the switching element is limited to a linear back and forth movement during the switch-over. That permits a robust design and manner of operation of the switching element and the control parts. The operation of the head only requires the movement of the respective control part located in front of the head, which brings about the 90° rotation of the control device. This conversion of the forward movement of the switching element into a rotational movement of the control device and the valve unit permits a relatively low-friction switch-over process and guarantees high long-term functional reliability.

Reliable switching of the control device and therefore of the valve unit is consequently achieved in this way. The next control part is already in a readiness position in front of the head at the end, when the switching element has returned to its inactive position, so that the head is brought into engagement with this control part during its next switching event and repeats the above-mentioned movement sequence. It already follows from this description that the control device always turns further by 90° in the same direction in the design of the switching device and control device in accordance with the invention and is not, as in the case of the known tool described above, rotated back and further during the switch-over.

The head of the switching element is preferably spring mounted at the switching elements front end in such a way that the head jumps in a spring-loaded way over the control part that has gotten into the readiness position when the switching element moves back into its inactive position. It is important in the process that the return movement of the head, and thus movement going outside of the purely linear movement as in the case of the extension of the switching element, will only take place when the switch-over of the valve unit has already taken place and is already complete.

The head is preferably attached to the switching element with a leaf spring, and the head preferably has a slanted surface on its back side that is brought into engagement with the control part in the readiness position during the return movement of the switching element and brings about a lifting of the head. A situation is simply achieved in this way in which the head can easily jump in a spring-loaded way over the control part that has already gotten into the readiness position during the return movement of the switching element.

When the head is attached to the switching element with a leaf spring for the spring-loaded jump over a control part that was brought into the readiness position, it is advisable for the switching element to have a driver in the area of the leaf spring that presses against the head during the forward movement of the switching element. The driver is not firmly connected to the head; instead, the driver presses against it during the forward movement of the head to support its movement of the relevant control part.

The control device preferably includes a carrier with rotatable bearings above the valve unit on which the four control parts are each arranged offset by 90° to each other. A compact and robust structure and design of the control device results in that way.

The carrier is preferably supported pivotally on a bearing bolt that extends upwards in a central position from a flow element in the housing.

Each control part preferably has a contact element at the upper end for the engagement with the head of the switching element. The contact element could have a cylindrical design, for instance. In any case, a simple and robust design for reliable engagement between the head of the switching element and the control part participating in the switch-over in each case also results for this.

A baffle with a cam profile is preferably provided on a slider attached to the front side of the switching element with which the contact element of the respective control part engages in its readiness position when the switching element is extended out to the active position. The carrier is reliably prevented from rotating further by more than 90° in this way, because the control part participating in the next switch-over engages with the cam profile of the baffle in its readiness position.

There are also provisions in the reverse direction for a precise and reliable switch-over of the control device and the valve unit in that at least one spring-mounted return stop is namely preferably provided on the carrier.

The carrier is preferably designed in the form of a guide ring, and the control parts are preferably attached to the inside of the guide ring by means of an arm in each case. There is only slight interference with the flow path of the water through the control device when the control parts are attached to the inside of the control ring by means of a narrow arm in each case.

Four return stops with ratchet springs are preferably provided on this carrier that each interact with a locking pin on the switching element. A simple and robust structure of the control device results overall in this way.

As an alternative to the design of the carrier as a guide ring, there are provisions according to a further development of the invention for the carrier to be designed in the form of a rotatable flow housing with a diametrically arranged partition wall that has flow channels on both sides with the four control parts extending upwards from the wall. A compact and stocky basis for the four control parts that project upwards from the partition wall results here.

The four control parts are preferably provided on a land that is attached to the top surface of the partition wall.

Whereas the forward stop is designed as it is in the first alternative, the return stop is designed in a concealed form in the second alternative. The return stop of the carrier is preferably provided on the top surface of the partition wall and covered by the lands.

Adherence to a precise 90° rotation during a back and forth movement of the switching element is ensured for each of the two alternatives in that way.

Figure 2:
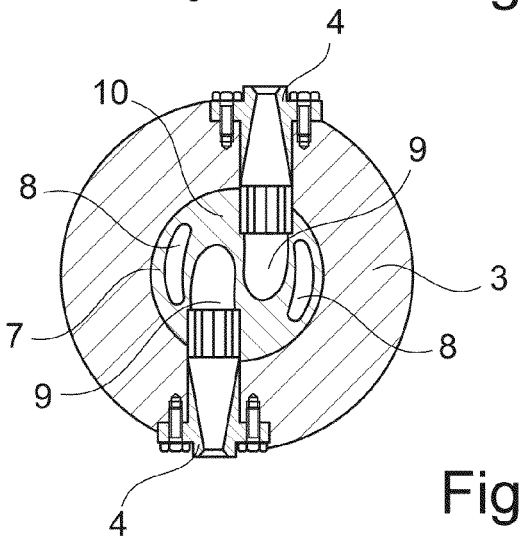
Figure 3:
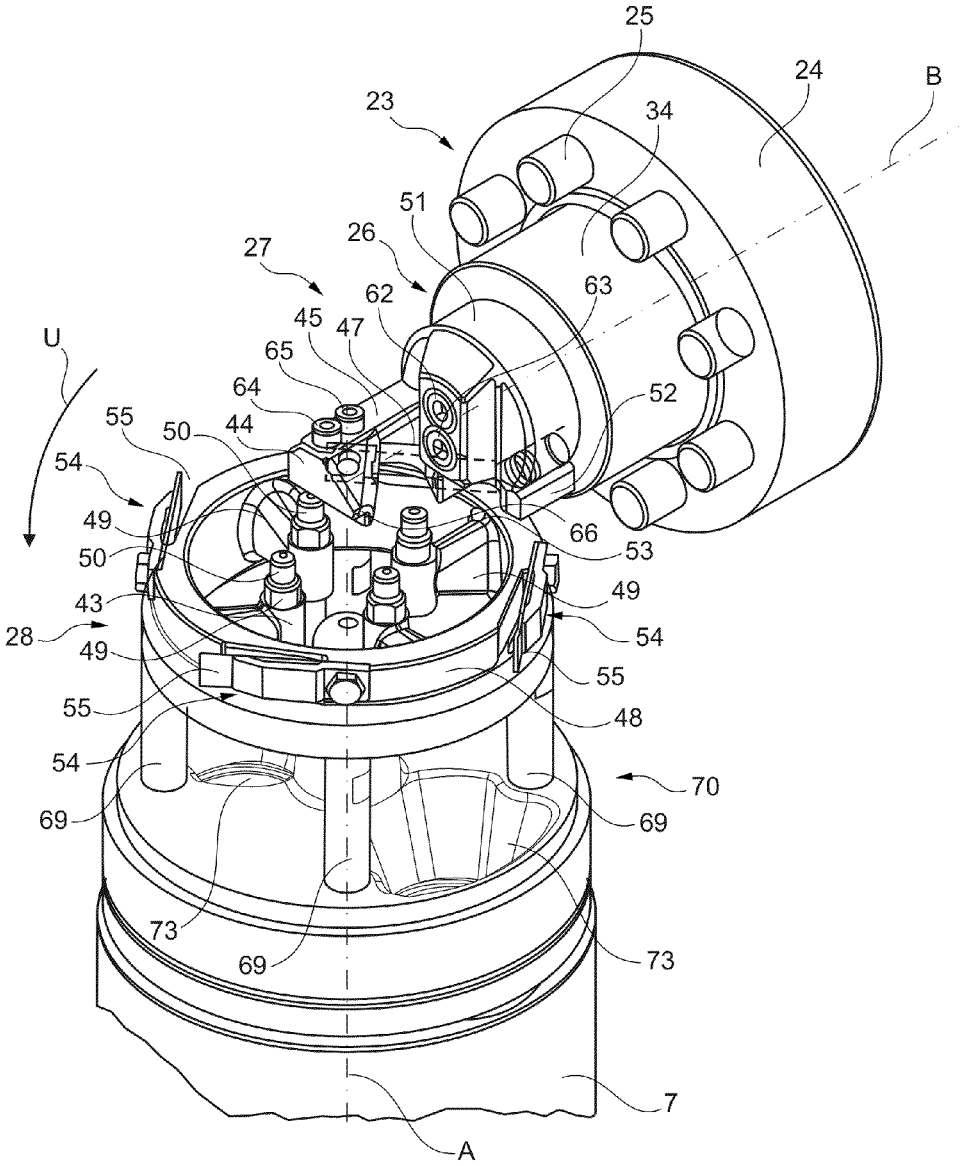
Figure 4:
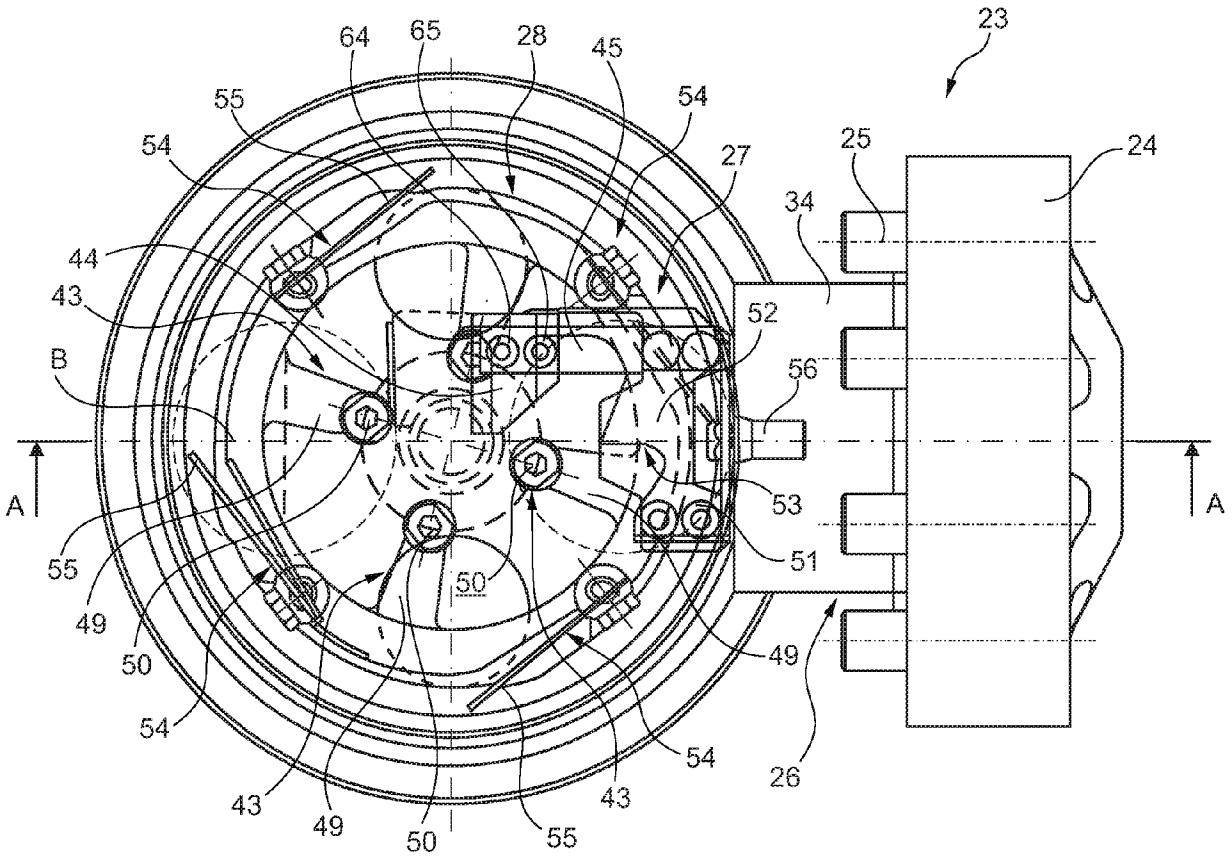
Figure 5:
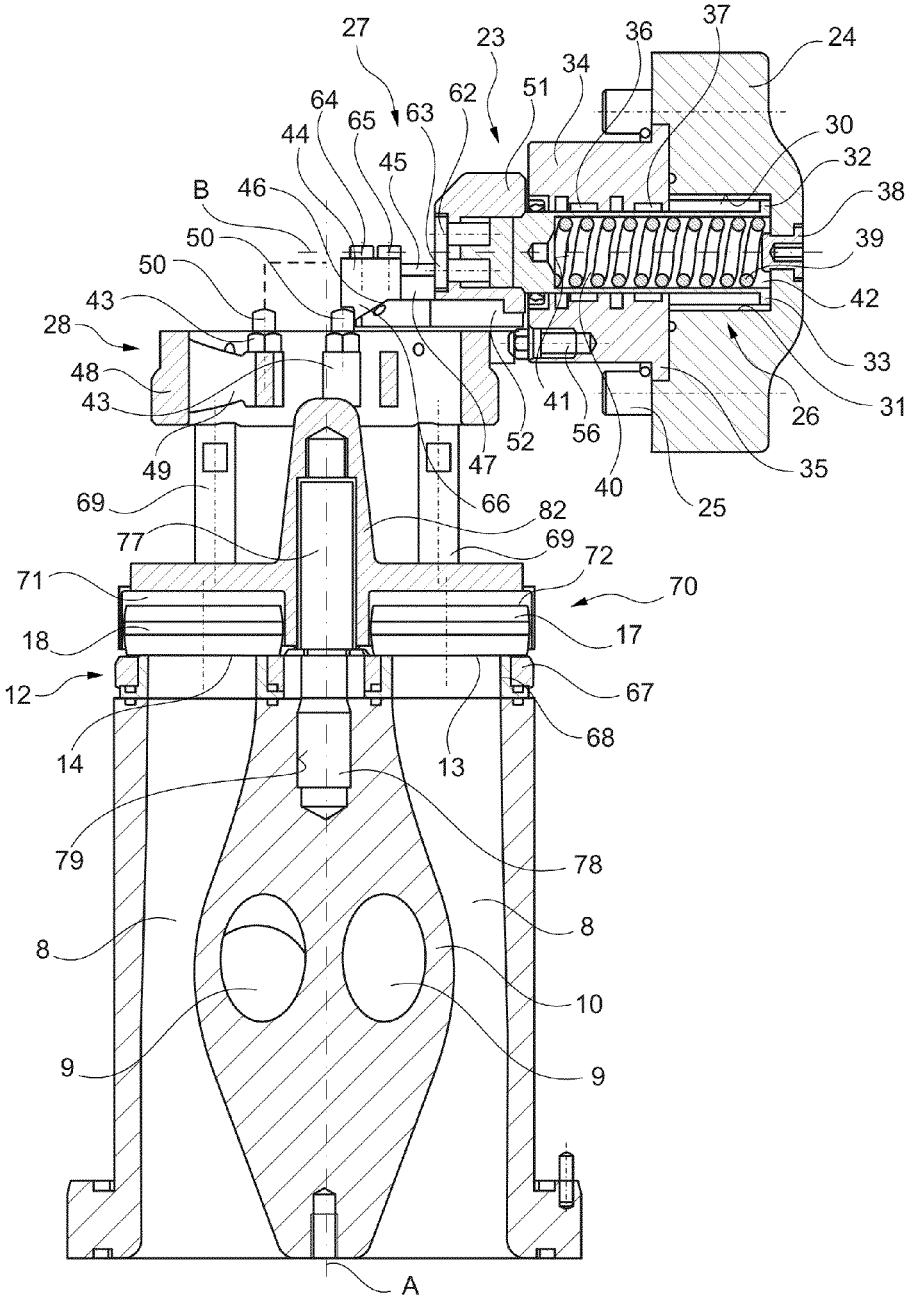
Figure 6:
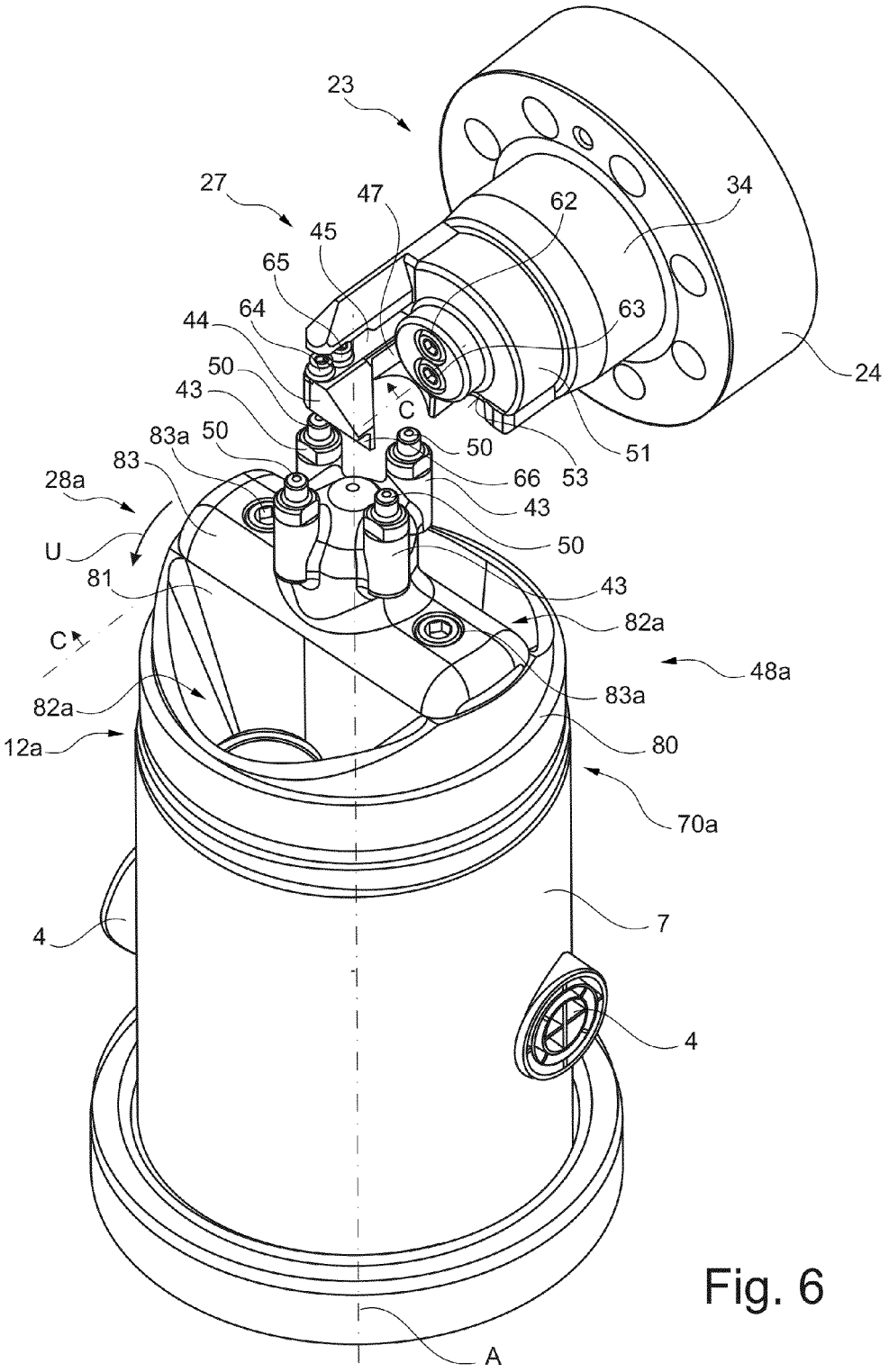
Figure 7:
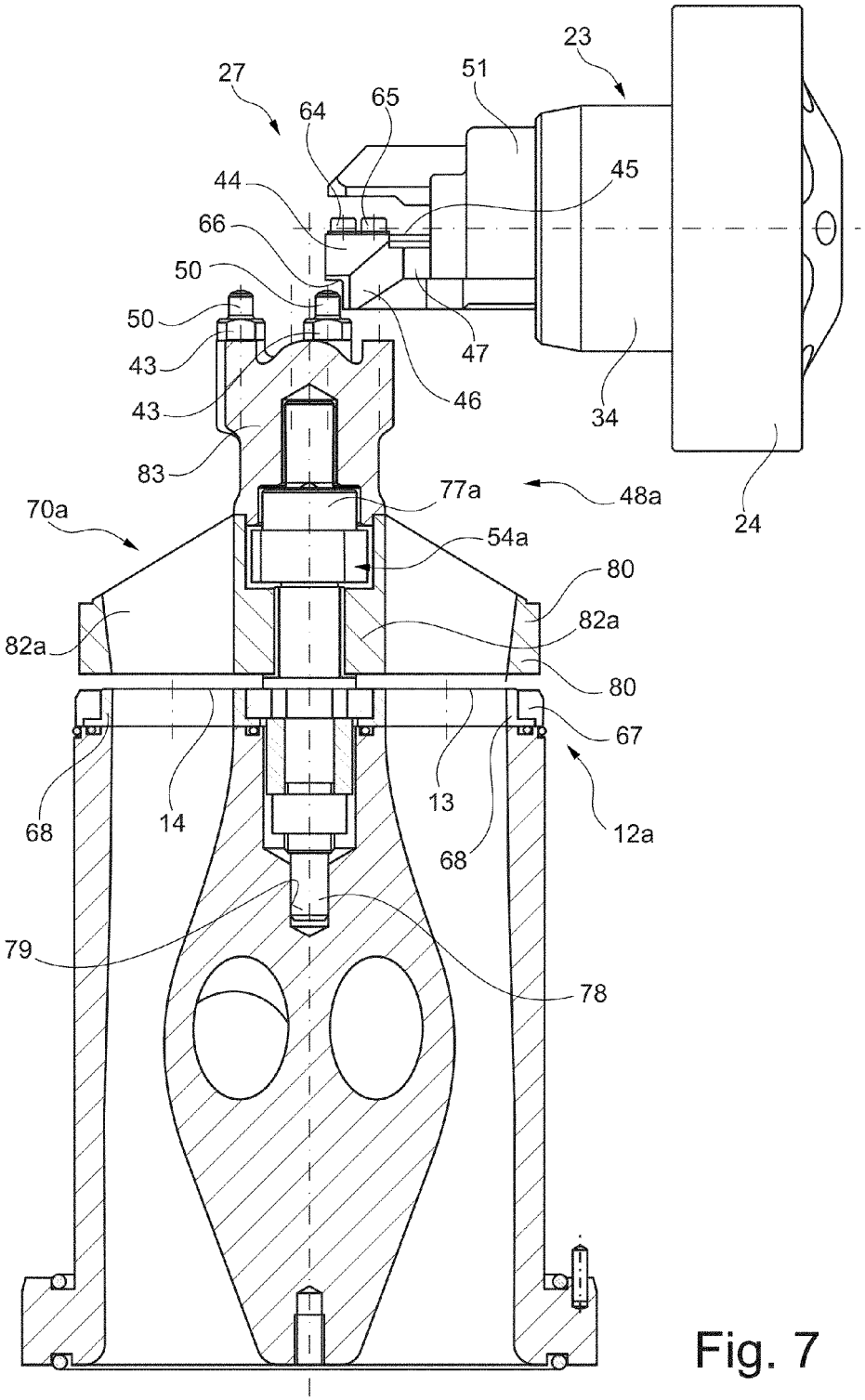

Embodiments of the invention will be explained in more detail below with reference to the drawings. The drawings show:

FIG. 1 a longitudinal section of a known tool for comminuting coke;

FIG. 2 a cross-sectional view of the tool of FIG. 1 along the line II-II of FIG. 1;

FIG. 3 a perspective view of a portion of the tool of FIGS. 1 and 2 designed in accordance with the invention with an arrangeable switching device with a driving device and with a switching element interacting with a control device for the actuation of a valve unit;

FIG. 4 a top view of the portion of the tool of FIG. 3;

FIG. 5 a sectional view of the portion of the tool of FIGS. 3 and 4 in the form of a longitudinal view along the line A-A of FIG. 4;

FIG. 6 a perspective view of an alternative design of a portion of the tool of FIGS. 3-5;

FIG. 7 a view of the alternative design of the tool portion of FIG. 6 in a section along the line C-C in FIG. 6.

A known tool 1 shown in FIGS. 1 and 2 for crushing coke in a drum (not shown) includes a housing 2 manufactured as a casting; a bottom part 5 with drilling nozzles 6, as shown, is attached to the housing's top part 3 with cutting nozzles 4 (cf. FIG. 2).

A hollow, cylindrical insert 7 with a flow element 10 that is essentially cylindrical and that flow channels 8, 9 (also cf. FIG. 2) extend through is arranged in the housing 2; the flow channels' upper openings 13, 14 (also cf. FIG. 5) can be closed in pairs via two disk-shaped closing elements 17, 18 of a valve unit 12. The valve unit 12 seals a flow-through channel 19 in that an inflow channel 20 enclosed at its upper end by a flange 21 leads into.

The tool 1 is attached in use to the end of a drilling rod that is not shown with the flange 21 and with the screw bolt 22; water under a high operating pressure of 300 bar, for instance, is guided when the tool 1 is being operated through the drilling rod and through the tool 1. Depending on the switch position of a control device 28 that connects a switching device 23 to a valve unit 12, it is either fed to the drilling nozzles 6 through the flow channels 8 and through an extension 11 or it is supplied to the cutting nozzles 4 through the flow channels 9 and carried out for drilling or cutting the coke material.

The switching device 23 extends outwards transversally to the longitudinal axis A of the tool 1 in its radial direction from a housing cover 24, which is attached removably to the top part 3 of the housing 2 (FIG. 1) by means of a screw bolt 25 and which is sealed with suitable means, to the area of the control device 28.

It especially follows from FIG. 5 that a splined hub 31 for seating a wedge ring 32 at the end of a piston 33 is inserted into a hole 30 of the housing cover 24 in order to make torsion-free movement of the piston 33 possible along a transverse axis B in a cylinder 34. The cylinder 34 is, as shown, embedded in the housing cover 24 and is held in place and sealed via a shoulder 35 with the fastening of the housing cover 24 in the top part 3 of the housing 2 (FIG. 1). An opening located in the center of the housing cover 24 is closed up and sealed with a sealing plug 38. The engagement of the wedge elements of the wedge ring 32 with the corresponding profile of the splined hub 31 prevents, as has already been indicated, a twisting of the piston 33 at an axial movement of the piston 33 in the cylinder 34 and in the splined hub 31 itself.

Guide strips 36, 37 embedded in the hole of the cylinder 34 are there to enable the piston 33 to easily slide in the cylinder 34.

The piston 33 is designed at the end in the form of an open hollow piston in the area of the wedge ring 32, and a coil spring 39 serving as a pressure spring and an energy or pressure accumulator unit that forms an essential part of the driving device 26 in combination with the piston 33 and the cylinder 34 is arranged in the piston's longitudinal hole 40. The coil spring 39 is supported on the bottom 41 of the longitudinal hole 40 at one end and on the base 42 of the hole 30 in the housing cover 24 at the other end.

In accordance with the invention, the switching device 23 shown in a circle N in FIG. 1 with the switching element 27 and the control device 28 are replaced by the design shown in FIGS. 3-7; this will especially be explained below.

At the front end of the piston 33 projecting from the cylinder 34, a slider 51 is attached by means of screw bolts 62, 63. A switching element 27 that extends in parallel to the transverse axis B is laterally attached next to the transverse axis B on the front side of the slider 51. The switching element 27 has a leaf spring 45 at the top that is firmly connected via the screw bolts 64, 65 with a head 44 at the front end of the switching element 27. Under the leaf spring 45 at a distance from it, a driver 47 projects out on the switching element 27, which abuts on the back side of the head 44. The head 44 has a slanted surface 46 at the bottom of its back side; its meaning will be explained later.

The control device 28 that was already mentioned is located below the driving device 26 and the switching element 27. It has four control parts 43 arranged concentrically offset by 90° to each other that are attached by means of an arm 49 in each case to the inside of a rotatable carrier 48, designed in the form of a guide ring here, in accordance with a first design type and alternative, and it has a contact element 50 at the upper end for the engagement with the head 44 of the switching element 27, which will be explained later.

The driving device 26 in the switching device 23 is designed in such a way that the piston 33 with the switching element 27 at the front end is pressed out of an inactive position shown in FIGS. 1, 3-4, in which the operating pressure of the water prevails and the coil spring 39 is pressed together as a pressure and energy accumulator unit, into an active position in the cylinder 34 when the operating pressure drops to a switching pressure of approx. 15 bar. The water pressure is dropped to the switching pressure when the tool 1 is to be switched over from "drilling" to "cutting" and vice versa. The other way around, the piston 33 is pressed from the active position back into the inactive position in the cylinder 34 again when the pressure in the water is increased from the switching pressure to the operating pressure again. Thus, manual intervention is not required to switch the tool 1 from "drilling" over to "cutting" or vice versa; the corresponding pressure control is only needed, as described.

When the piston 33 is pressed back to the limit stop of the wedge ring 32 on the base 42 of the hole 30, the coil spring 39 is pressed together as an energy accumulator and the slider 51 comes close to contact with the front side of the cylinder 34. With that, the switching device 23 with its components, especially the piston 33, has taken its inactive position.

When the operating pressure of the water is lowered at the end of an operating period to switch the tool 1 over from "drilling" to "cutting" or vice versa and the switching pressure is reached in the process, the compressive force of the water acting on the piston 33 falls under the restoring force of the coil spring 39, so the coil spring 39 presses the piston 33 from the inactive position into the active position. This means that the piston 33 with the switching element 27 at the front end is moved on a linear basis in parallel with the transverse axis B and perpendicular to the longitudinal axis A—with reference to the presentation in FIG. 5—to the left, namely away from the cylinder 34. During this forward movement of the switching element 27, the head 44 is brought into engagement with the control part among the four control parts 43 that is in a readiness position in front of the head 44 and the head 44 moves the control part 43 via its linear movement so far that the control device 28 rotates by 90° and the head 44 is in the position drawn in with the dot-and-dash line in FIG. 5. The ring-shaped carrier 48 rotates, as stated, by 90° during the forward movement of the switching element 27; the contact element 50 of the respective control part 43 is in engagement with a straight pressure profile 66 at the bottom of the head 44 and a sliding movement takes place there in parallel with the rotary movement of the carrier 48. The driver 47 of the switching element 27 primarily exerts the pressure required to move the respective control part 43.

The head 44 is also correspondingly pulled back during the return movement of the switching element 27 when the piston 33 returns to its inactive position in the cylinder 34 again.

When the head 44 has moved a control part 43 such that the carrier 48 has carried out a 90° rotation, the next control part 43 has already reached its readiness position, and it is therefore behind the head 44 and consequently in a path with its contact element 50 that would follow the head 44 on its return path if the switching element 27 moves back into its inactive position. As a solution, there are therefore provisions for the head 44 to be able to jump in a spring-loaded way during its return movement over the control part 43 that has already gone into its readiness position, with the spring loading namely based on the characteristics of the leaf spring 45 with the support of the slanted surface 46 on the back side of the head 44, which makes it easier to raise the head 44, when the head 44 pushes at the beginning of its return movement against the contact element 50 of the control part 43 in the readiness position.

The control device 28 with the carrier 48 is rotated further by 90° in the clockwise direction U (FIG. 3) with every switching event. A baffle 52 with a cam profile 53 with which the contact element 50 of the respective control part 43 is brought into engagement in its readiness position when the switching element 27 is moved out into the active position is provided at the front of the slider 51 so that the control device does not rotate further, but instead holds to a rotation angle of exactly 90°.

A return rotation of the carrier 48 during the switch-over is also prevented and, in fact, by four spring-loaded return stops 54; their ratchet springs 55 interact with a locking pin 56 on the switching element 27 and prevent any return in that way.

The carrier 48 is, as the drawings illustrate, fastened to supports 69 that are attached for their part to a guide device 70 for the valve unit 12. The guide device 70 includes segmented chambers 71, 72 open at the bottom between which openings 73 are formed in each case. The housing of the chambers 71, 72 of the guide device 70 overlaps onto the disk-shaped closing elements 17, 18 in every position like a cage; that is also the case in the operating position "cutting" shown in FIG. 5 when the closing elements 17, 18 namely close the flow channels 8 leading to the drilling nozzles 6. A valve plate 67 with valve inserts 68 is inserted between the chambers 71, 72 and the flow channels 8, 9; the openings 13, 14 of the flow channels 8 leading to the drilling nozzles 6 are located on the top surface of the valve plate.

On the top surface of the flow element 10, a bearing bolt 77 with a threaded section 78 in a coaxial position is firmly screwed into a corresponding threaded hole 79 of the flow element 10 at its lower end. A hub part 82 supporting the guide device 70 with the supports 69 is hinged on the bearing bolt 77. Every movement of one of the four control parts 43 caused by the switching element 27 and its head 44 is converted in this way into a 90° rotary movement of the control device 28 with the guide device 70 to move the closing elements 17, 18 of the valve unit 12, in order to switch the tool 1 from "cutting" over to "drilling" and vice versa.

The alternative version shown in FIGS. 6-7 refers, as the drawings show, to the design of a control device 28*a* with a carrier 48*a* rotatably mounted on a bearing bolt 77*a* and a guide device 70*a* adapted to it, as well as a corresponding valve unit 12*a*. The switching device 23 with the switching element 27 and its interaction with the contact elements 50—in the same arrangement as in FIGS. 3-5—and the design of the valve unit 12*a* essentially correspond to the design of FIGS. 3-5. The following description will therefore be limited to the differences in the alternative version of FIGS. 6-8.

The carrier 48*a* is designed as a flow housing 80 rotatable on the bearing bolt 77*a* with a diametrically arranged partition wall 81 from which the four control parts 43 project in an upwards direction in basically the same arrangement as in the first example, but starting from a common base part here, for the engagement with the head 44 of the switching element 27. Flow channels 82*a* are located on both sides of the partition wall 81.

A land 83 (FIG. 6) is attached with screws 83*a* to a top surface 84 of the partition wall 81; the four control parts 43 extend upwards from the land.

A return stop 54*a* is arranged on the top surface 84 under the land 83 and prevents an undesired return of the carrier 48*a*.

A protective profile 57 extending out from the slider 51 runs over the head 44. The forward stop with the baffle 52 (FIG. 7) corresponds to that of the first version.

The guide device 70*a* and the valve unit 12*a* (shown in a sectional plane that is offset by 90° in FIG. 5) are not even separately shown in FIG. 7, because the corresponding design of the valve unit 12 from FIG. 5 can be transferred for this without further ado to the alternative version of FIGS. 6 and 7 and the presentation of the guide device 70*a* suffices for an understanding of the structure.

The way in which this alternative version works otherwise corresponds to that of FIGS. 3-5 with the difference that the flow channels 82*a* are provided here for the water supply to the guide device 70 and to the valve unit 12.

The invention claimed is:

1. A tool for crushing coke comprising:

a housing that, in an operating state of the tool, is attached adjacent an end of a rotatably drivable drilling rod;

at least one cutting nozzle for cutting coke in a drum by means of a water jet;

at least one drilling nozzle for drilling coke in a drum by means of a water jet;

an inflow channel in the housing for receiving water flowing under pressure into the housing through the drilling rod;

a valve unit for distributing water from the inflow channel into flow channels in communication with the cutting nozzle and the drilling nozzle;

a control device that is rotatable relative to the longitudinal axis of the housing to actuate the valve unit to open or close a flow path of the water to the cutting nozzle or to the drilling nozzle depending on a rotational position of the control device;

a driving device that is automatically actuated based on changes in the pressure of the water relative to an operating pressure and a switching pressure, wherein the switching pressure is different than the operating pressure, and wherein the driving device causes a switching element to contact the control device, thereby causing the control device to rotate through a switching angle, wherein the switching element is moved by the driving device from an inactive position transversally relative to the longitudinal axis of the housing into an active position in a linear fashion when the water pressure attains the switching pressure and is moved back into the inactive position when the pressure of the water attains the operating pressure, wherein the switching element is coupled to means for converting linear movement into rotary movement of the control device, wherein the switching element is engaged with control parts of the control device to rotate the control device, wherein the control device includes four control parts concentrically offset by 90° relative to each other, wherein the switching element has a head that is brought into engagement with one of the four control parts during the forward movement of the switching element from the inactive position to the active position, wherein the head engages the control part among the four control parts that had moved into a readiness position in front of the head at the end of a prior switch-over when the switching element had moved to the inactive position, and wherein the head moves the engaged control part via linear movement of the switching element to cause the control device to rotate by 90°.

2. The tool according to claim 1, wherein the head is mounted in a spring-loaded way to a front end of the switching element such that the head may jump over the control part that is in the readiness position when the switching element moves back into the inactive position.

3. The tool according to claim 2, wherein the head is mounted with a leaf spring to the switching element and the head has a slanted surface that engages the control part in the readiness position and lifts the head over the control part during the return movement of the switching element.

4. The tool according to claim 3, wherein the switching element has a driver adjacent the leaf spring that presses against the head during the forward movement of the switching element.

5. The tool according to claim 1, wherein the control device includes a carrier mounted rotatably above the valve unit, and the four control parts are mounted on the carrier.

6. The tool according to claim 5, wherein the carrier is mounted rotatably on a bearing bolt that extends upwards in a central position from a flow element in the housing.

7. The tool according to claim 1, wherein each control part has a contact element at an upper end for engaging the head of the switching element.

8. The tool according to claim 1 further comprising a baffle with a cam profile disposed on a slider attached to a front side of the switching element, which baffle engages a contact element of the respective control part in its readiness position when the switching element is extended out to the active position.

9. The tool according to claim 5, wherein the carrier includes at least one spring-loaded return stop.

10. The tool according to claim 5, wherein the carrier comprises a guide ring and the control parts are attached to the inside of the guide ring by means of an arm in each case.

11. The tool according to claim 10, wherein the carrier includes four return stops with ratchet springs that each interact with a locking pin on the switching element.

12. The tool according to claim 6, wherein the carrier comprises a flow housing that can rotate on the bearing bolt and a diametrically arranged partition wall having flow channels on opposing sides, wherein the four control parts extend upwards from the partition wall.

13. The tool according to claim 12, wherein the four control parts are disposed on a land attached to a top surface of the partition wall.

14. The tool according to claim 13, wherein a return stop is disposed on the top surface of the partition wall which blocks a return of the carrier and which is covered by the land.

15. A tool for crushing coke comprising:

a housing;

one or more cutting nozzles disposed adjacent the housing for cutting coke by means of a water jet;

one or more drilling nozzles disposed adjacent the housing for drilling coke by means of a water jet;

a control device rotatable relative to the longitudinal axis of the housing, the control device operable to actuate the one or more cutting nozzles or the one or more drilling nozzles when the control device rotates through a switching angle, the control device having one or more control parts that rotate relative to the longitudinal axis of the housing as the control device rotates; and a driving device that is actuated in response to changes in water pressure between an operating pressure and a switching pressure;

wherein the driving device moves linearly and transversally relative to the longitudinal axis of the housing to cause a switching element to move from an inactive position to an active position when the water pressure attains the switching pressure, and to move from the active position to the inactive position when the water pressure attains the operating pressure, and wherein the switching element engages one or more control parts of the control device to cause the control device to rotate through the switching angle when the switching element moves from the inactive position to the active position, wherein the switching element includes a head for engaging the one or more control parts of the control device, and wherein the head is connected to a front end of the switching element by a bias element such that the head is operable to translate over one of the control parts that is in a readiness position when the switching element moves back into the inactive position.

16. The tool according to claim 15 wherein the one or more control parts of the control device comprise four control parts concentrically offset by 90° relative to each other.

17. A tool for crushing coke using high-pressure water, the tool comprising:

a housing configured to be attached to a drilling rod;

an inflow channel for receiving water flowing under pressure into the housing;

a control device attached to the housing and rotatable between multiple rotational positions, the control device for directing the flow of the water into one or more drilling nozzles disposed in the housing when the control device is in at least one of the rotational positions and into one or more cutting nozzles disposed in the housing when the control device is in at least one of the rotational positions;

a switching element in communication with the inflow channel and actuated based on changes of the pressure of the water flowing into the inflow channel, the switching element operable to engage the control device to cause the control device to rotate from one rotational position to another rotational position, wherein the control device includes four control parts concentrically offset by 90° relative to each other, wherein the switching element has a head that is brought into engagement with one of the four control parts during the forward movement of the switching element from an inactive position to an active position, wherein the head engages the control part among the four control parts that had moved into a readiness position in front of the head at the end of a prior switch-over when the switching element had moved to the inactive position, and wherein the head moves the engaged control part via linear movement of the switching element to cause the control device to rotate by 90°.

* * * * *